United States Patent [19]

White

[11] Patent Number: 4,579,312

[45] Date of Patent: Apr. 1, 1986

[54] FLEXIBLE FORM

[76] Inventor: Lee R. White, 1137 W. Emerald, Mesa, Ariz. 85202

[21] Appl. No.: 635,935

[22] Filed: Jul. 30, 1984

[51] Int. Cl.[4] ..... E01C 19/50

[52] U.S. Cl. ..... 249/6; 249/7; 249/134; 249/192

[58] Field of Search ..... 249/1, 2, 3, 6, 7, 192, 249/134, 135, 183, DIG. 3

[56] References Cited

U.S. PATENT DOCUMENTS

| | | | |
|---|---|---|---|
| 1,202,269 | 10/1916 | Cramer | 249/6 |
| 1,348,060 | 7/1920 | Sheppard | 249/7 |
| 1,561,923 | 11/1925 | Heltzel | 249/6 |
| 1,849,758 | 3/1932 | Heller | 249/192 |
| 2,017,553 | 10/1935 | Troiel | 249/192 |
| 2,626,444 | 1/1953 | Wolf et al. | 249/6 |
| 2,663,925 | 12/1953 | Yates | 249/7 |
| 2,688,787 | 9/1954 | Lawler | 249/7 |
| 2,846,748 | 8/1958 | Owen et al. | 249/7 |
| 3,123,887 | 3/1964 | Boettner | 249/192 |
| 4,340,200 | 7/1982 | Stegmeier | 249/6 |

*Primary Examiner*—Jay H. Woo
*Assistant Examiner*—James C. Housel
*Attorney, Agent, or Firm*—Harry M. Weiss & Associates

[57] ABSTRACT

An elongated flexible form is presented. The elongated flexible form may be shaped to fit the contour of a concrete structure of variable shape and is held in position by a plurality of positioning brackets. The flexible form is made out of a flexible material such as natural or synthetic rubber and may be reinforced by wire, cables, steel belts, nylon cord, ply material or a combination of the same. Each of the positioning brackets has a hollow body portion which is bolted to the flexible form. A stake and wedge are used to hold each bracket in place. Connecting flanges may be used to attach the end of the flexible form to another flexible form or to a metal form. The connecting flanges are bolted to the end of each form and are held together by a fastening device. Another embodiment of the positioning brackets may be bolted to the end of the flexible form and also used for the purpose of attaching the end of the flexible form to another form.

1 Claim, 10 Drawing Figures

FLEXIBLE FORM

BACKGROUND OF THE INVENTION

The present invention relates generally to forms used for pouring concrete structures and, more specifically, to a flexible form that may be used for pouring concrete structures of variable shape.

Flexible sheet metal forms or wooden forms are often used for the purpose of pouring concrete structures such as curbs, walls or sidewalks of variable shape. However, wooden forms generally are not reusable and are difficult to use due to their lack of flexibility. In addition, sheet metal forms are expensive and difficult to use when pouring concrete structures of variable shape. In the case of concrete structures with extreme changes in contour or shape, it would be impractical to use wooden or sheet metal forms.

Accordingly, there is a need for a form made out of a flexible material such as natural or synthetic rubber which may be used for pouring concrete structures of variable shape. The flexible form should be reinforced by wire, cables, steel belts, nylon cord, ply material or a combination of the same. In addition, the flexible form should be capable of being used in conjunction with existing metal forms.

SUMMARY OF THE INVENTION

It is an object of this invention to provide an improved flexible form that may be used for pouring concrete structures of variable shape.

It is still another object of this invention to provide an improved flexible form made out of a reinforced flexible material.

It is still another object of this invention to provide an improved flexible form which may be used in conjunction with existing metal forms.

In accordance with one embodiment of this invention, a flexible form for use in concrete work is disclosed which comprises an elongated flexible member capable of being bent and shaped during use as a concrete form in order to fit the variable contour of a concrete structure, the flexible member resting on one of its longitudinal edges which extends lengthwise in a horizontal direction and having at least one substantially flat vertical side; and positioning bracket means operably and removably coupled to the flexible member for supporting and anchoring the flexible member. In this embodiment, an elongated flexible form which may be shaped to fit the contour of a concrete structure of variable shape is held in position by a plurality of positioning brackets. The flexible form is made out of a flexible material such as natural or synthetic rubber and may be reinforced by wire, cables, steel belts, nylon cord, ply material or a combination of the same. Each of the positioning brackets has a hollow body portion which is bolted to the flexible form. A stake and wedge are used to hold each bracket in place. Connecting flanges may be used to attach the end of the flexible form to another flexible form or to a metal form. The connecting flanges are bolted to the end of each form and are held together by a fastening device. Another embodiment of the positioning brackets may be bolted to the end of the flexible form and also used for the purpose of attaching the end of the flexible form to another form.

The foregoing and other objects, features and advantages of this invention will be apparent from the following, more particular, description of the preferred embodiments of the invention, as illustrated in the accompanying drawings.

DESCRIPTION OF THE PREFERRED EMBODIMENT

Figure 1:
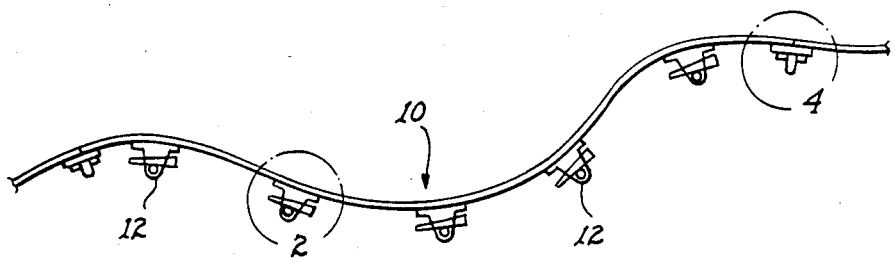
FIG. 1 is a top view showing a flexible form connected to two adjacent forms by connecting flanges with a plurality of positioning brackets holding the form in place.

FIG. 1 shows a flexible form, generally designated by reference number 10. The flexible form 10 is preferably made out of a flexible material such as natural or synthetic rubber, flexible plastic, or the like. Since the form 10 is flexible, it may be shaped to fit concrete structures of variable shape such as curbs. The flexible form 10 is held in place by a plurality of positioning brackets 12.

Figure 2:
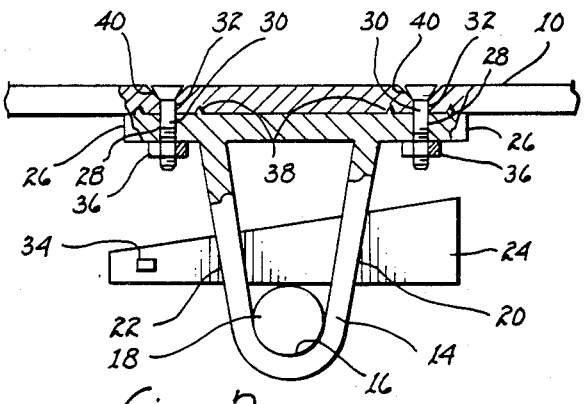
FIG. 2 is an enlarged view of one of the positioning brackets (circled in FIG. 1) showing how a wedge and stake are used with the bracket.
Figure 3:
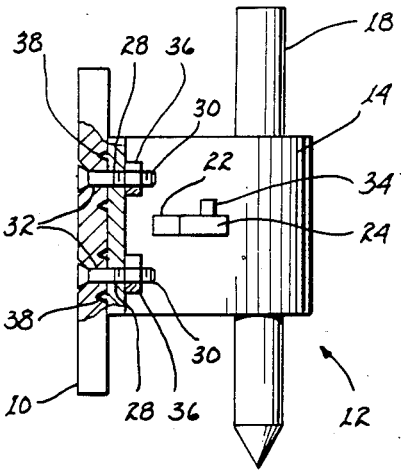
FIG. 3 is a side elevational view of the positioning bracket of FIG. 2.

An enlarged view of one of the positioning brackets 12 is shown in FIG. 2. FIG. 3 is a side view of the positioning bracket 12. The positioning bracket 12 has a hollow body portion 14 having a curved inside surface 16 for engaging a stake 18. A wedge 24 slidably engages slots 20 and 22 in the hollow body portion 14. The wedge 24 has an extension 34 which prevents the wedge 24 from sliding out of the slots 20 and 22. The hollow body portion 14 has two flanges 26 with apertures 28 which are used to bolt it to the flexible form 10. Bolts 30 pass through the apertures 28 in the flanges 26 and apertures 32 in the flexible form 10. Note that each aperture 32 has a countersink 40. The heads of the bolts 30 are formed to fit the countersinks 40. Counterbores (not shown) may be used instead of countersinks 40 if desired. Also washers (not shown) may be used to reduce bearing stresses acting on the flexible form 10. Plates (not shown) molded into the flexible form 10 or fit into an aperture in the form 10 may be used with other bolts (not shown). The bolts 30 are used in conjunction with nuts 36 to secure the hollow body portion 14 to the flexible form 10. It is important to note that any other suitable means of fastening the positioning bracket 12 to the flexible form 10 may be used instead of nuts 36 and bolts 30 such as screws, clamps or rivets (not shown). The hollow body portion 14 has gripping teeth 38 which penetrate the flexible form 10. After the positioning bracket 12 is bolted to the flexible form 10, the stake 18 is placed inside the hollow body portion 14 and driven into the ground. The wedge 24 is then inserted through slots 20 and 22 until it comes into contact with the stake 18 forcing it against the curved inside surface 16.

Figure 7:
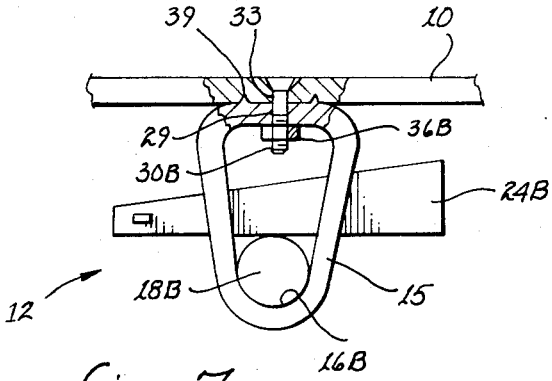
FIG. 7 is another embodiment of the positioning brackets.

Another embodiment of the positioning bracket 12 is shown in FIG. 7. This embodiment is particularly useful when the shape of the concrete structure to be poured is subject to abrupt change. Note that a hollow body 15 is bolted to the flexible form 10 by two bolts 30B (only one of the two bolts 30B is shown) passing through apertures 29 and 33 in the hollow body portion 15 and flexible form 10, respectively. The hollow body portion 15 has gripping teeth 39 which assist in securing the positioning bracket 12 to the form 10.

Figure 4:
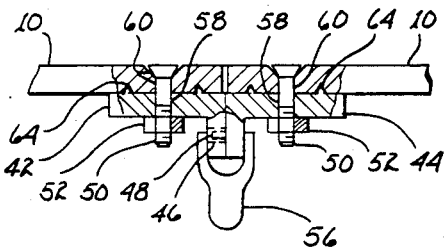
FIG. 4 is an enlarged view of two connecting flanges (circled in FIG. 1) showing how a fastening device is used with the flanges to secure the ends of two flexible forms together.

Referring to FIG. 4, the ends of two flexible forms 10 are shown held together by two connecting flanges 42 and 44. One flange 44 has extensions 48 which may be removably inserted into apertures 46 in the other flange 42. The flanges 42 and 44 and ends of the forms 10 have apertures 58 and 60, respectively. The ends of the flexible form 10 are joined as follows. First, the flanges 42 and 44 are bolted to the ends of the flexible forms 10 by the use of bolts 50 (which pass through the apertures 58 and 60) and nuts 52, and the extensions 48 are inserted into the apertures 46. The flanges 42 and 44 are then clamped together by a fastening device 56. The fastening device 56 is rotatably coupled to one of the flanges 42 and 44 at point 62 (see FIG. 5). The flanges 42 and 44 preferably have gripping teeth 64. However, if one end of the flexible form 10 is being fastened to a metal form (not shown), then a flange (not shown) bolted to the metal form would not have gripping teeth 64.

Figure 5:
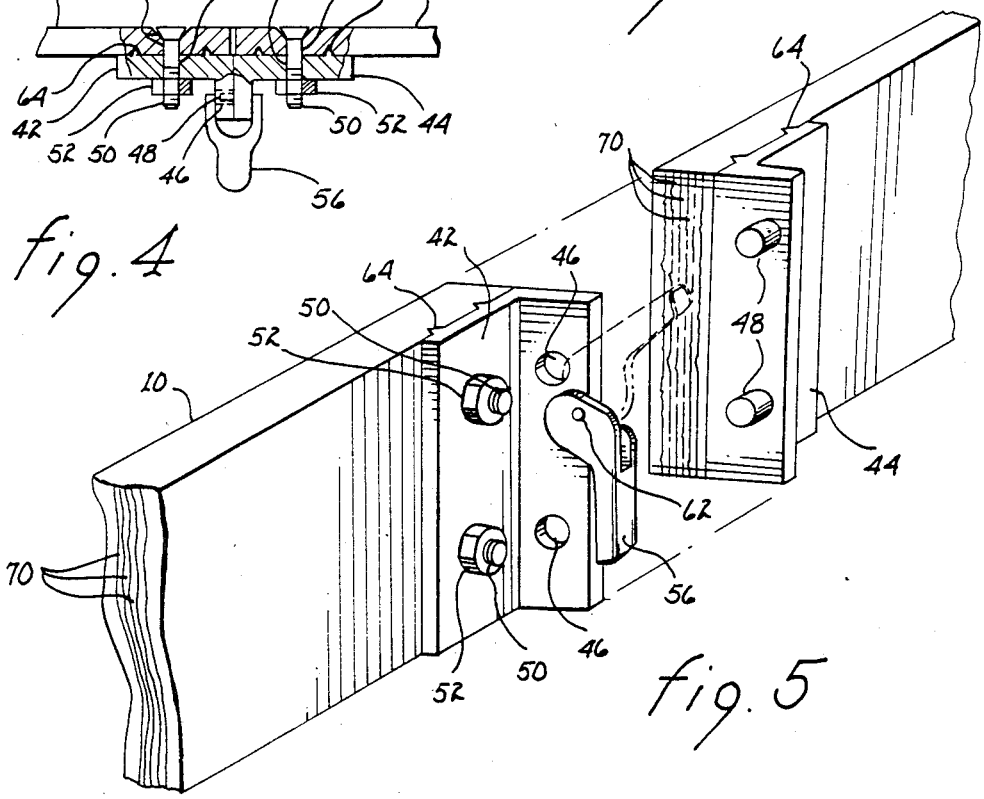
FIG. 5 is an exploded perspective view of the joint of FIG. 4 illustrating by dashed lines how the fastening device may be moved to an upward position in order to release the flanges.
Figure 8:
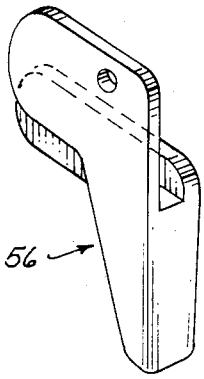
FIG. 8 is an enlarged perspective view of the fastening device.

An exploded view of the joint of FIG. 4 is shown in FIG. 5. Note how the fastening device 56 may be moved to an upward position (indicated by dashed lines) in order to release the flanges 42 and 44. Conversely, the flanges 42 and 44 are pressed together when the device 56 is moved in a downward direction. An enlarged perspective view of the fastening device 56 is shown in FIG. 8. Any suitable means of fastening the flanges 42 and 44 to the flexible form 10 may be used instead of nuts 52 and bolts 50. Likewise, the fastening device 56 may be replaced by other types of clamping devices (not shown).

Figure 6:
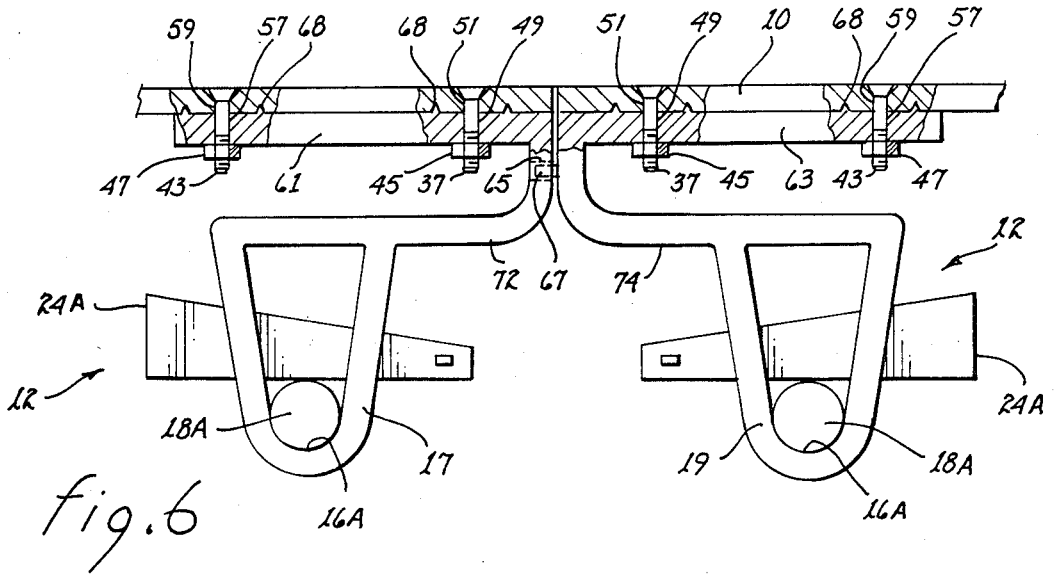
FIG. 6 is a top view showing how a different embodiment of the positioning brackets may be used to secure the ends of two forms together.

FIG. 6 shows another embodiment of the positioning brackets 12 which may be used to connect the ends of two flexible forms 10. A separate positioning bracket 12 is attached to the end of each flexible form 10. Each of the positioning brackets 12 has a hollow body portion 17 and 19, a curved portion 72 and 74, and an extended flange 61 and 63. The curved portion 72 of one positioning bracket 12 has apertures 65 (preferably two) while the other bracket 12 has extensions 67 (preferably two) which may be removably inserted into the apertures 65. The extended flanges 61 and 63 of each positioning bracket 12 are bolted to the ends of the flexible forms 10 by the use of bolts 37 and 43 (which pass through apertures 49, 51, 57 and 59) and nuts 45 and 47. The extensions 67 are inserted into the apertures 65 as shown in FIG. 6. The extended flanges 61 and 63 have gripping teeth 68. Stakes 18A and wedges 24A (see FIG. 6) are used in conjunction with the positioning brackets 12. As a result, the fastening device 56 shown in FIGS. 4 and 5 is not needed. It is important to note that this embodiment of the positioning bracket 12 may be used to secure the end of a flexible form 10 to a metal form (not shown) as discussed above (see discussion concerning the connecting flanges 42 and 44 shown in FIGS. 4 and 5).

The positioning brackets 12 and connecting flanges 42 and 44 are preferably made out of metal. However, any suitable material may be used.

Figure 9:
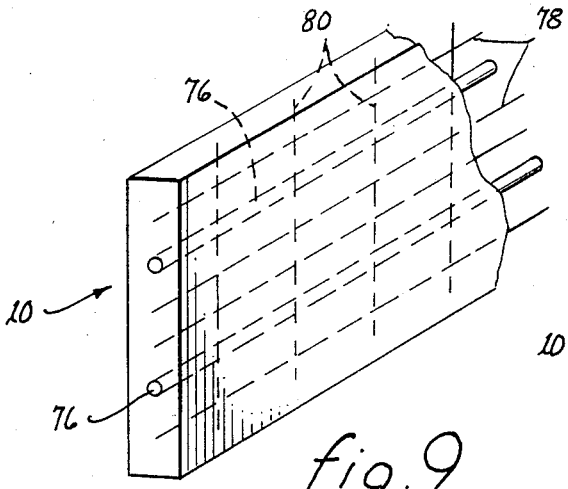
FIG. 9 is a perspective view of a reinforced flexible form using wire and steel cables for reinforcement.
Figure 10:
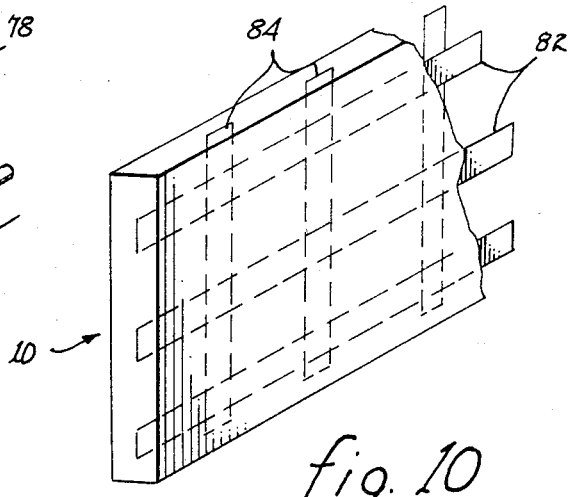
FIG. 10 is a perspective view of another reinforced flexible form using steel belts for reinforcement.

As shown in FIGS. 5, 9 and 10, the flexible form 10 may be reinforced. FIG. 5 shows how ply material 70 may be used to reinforce the flexible form 10. Any desirable number of layers of ply material 70 such as nylon fabric may be used for reinforcement. FIGS. 9 and 10 illustrate how steel cables 76, wire 78 and 80 and steel belts 82 and 84 may be used to reinforce the flexible form 10. In addition, other materials such as nylon cord (not shown) may be used for reinforcement. Moreover, any combination of these materials may be used to reinforce the form 10.

While the invention has been particularly shown and described in reference to preferred embodiments thereof, it will be understood by those skilled in the art that changes in the form and details may be made therein without departing from the spirit and scope of the invention.

I claim:

1. A flexible form for use in concrete work, comprising:

(a) an elongated flexible member made of a flexible strip of elastic material of substantially uniform thickness selected from the group consisting of flexible plastic, synthetic rubber and natural rubber, said elastic material being reinforced by ply material selected from the group consisting of steel cables, wires, steel belts, nylon cord and nylon fabric, said flexible member capable of being bent and shaped during use as a concrete form in order to fit the variable contour of a concrete structure and suitable for adapting to rest on one of its longitudinal edges which extends lengthwise in a horizontal direction and having at least one substantially flat vertical side, said flexible member has a plurality of sets of apertures passing therethrough wherein each set comprises at least four apertures;

(b) positioning bracket member operably and removably coupled to a side opposite said substantially flat vertical side of said flexible member for supporting and anchoring said flexible member, said bracket member comprises: (i) a hollow body portion having a plurality of slots passing therethrough, said hollow body portion has gripping teeth for securely attaching said flexible member thereto; (ii) flange portions integrally attached to an end portion of said hollow body portion abutting said flexible member having a plurality of apertures for accommodating therein a fastening means for fastening and aligning said bracket member onto said flexible member; (iii) a stake removably inserted inside said hollow body portion; and (iv) a wedge slidably engaging said slots and operably securing said stake inside said hollow body portion;

(c) a connecting means for operably coupling to one end of said flexible member and to an end of another flexible member for removably attaching therewith, said connecting means comprises: (i) a first member having a first flange with apertures passing therethrough to accommodate a fastening device and a plurality of teeth protruding therefrom to permit said first flange to be removably attached to in substantially parallel relation to said flexible member, said first member having a second integral flange substantially perpendicular to said first flange and outwardly extending from said flexible member, said second flange having a plurality of apertures passing therethrough; (ii) a second member having a first flange with apertures passing therethrough to accommodate a first fastening device and a plurality of teeth protruding therefrom to permit said first flange to be removably attached to in substantially parallel relation to said flexible member, said second member further having a second integral flange substantially perpendicular to said first flange and outwardly extending from said flexible member, said second flange of said second member having a plurality of extending members suitable for fitting through said plurality of apertures passing through said second flange of said first member to permit said second flanges of both first and second members to abut and join each other in substantially parallel relation thereto second; (iii) a second fastening device operably coupled to at least one of said second flanges of said first and second members for removably attaching said second flanges together after said first flanges are removably attached to said ends of said flexible member and said another flexible member.

* * * * *